US009328559B2

(12) United States Patent
Schwarz et al.

(10) Patent No.: US 9,328,559 B2
(45) Date of Patent: May 3, 2016

(54) DIRECT DRILL BIT DRIVE FOR TOOLS ON THE BASIS OF A HEAT ENGINE

(76) Inventors: Marcus Schwarz, Freiberg (DE); Ulf Kirsten, Nossen (DE); Matthias Reich, Freiberg (DE); Silke Röntzsch, Grossröhrsdorf (DE); Florian Mertens, Freiberg (DE)

( * ) Notice: Subject to any disclaimer, the term of this patent is extended or adjusted under 35 U.S.C. 154(b) by 514 days.

(21) Appl. No.: 13/882,509

(22) PCT Filed: Oct. 21, 2011

(86) PCT No.: PCT/DE2011/001878

§ 371 (c)(1),
(2), (4) Date: Apr. 30, 2013

(87) PCT Pub. No.: WO2012/055392

PCT Pub. Date: May 3, 2012

(65) Prior Publication Data

US 2013/0220656 A1 Aug. 29, 2013

(30) Foreign Application Priority Data

Oct. 30, 2010 (DE) ..... 10 2010 050 244

(51) Int. Cl.

| | |
|---|---|
| ***E21B 4/14*** | (2006.01) |
| ***E21B 4/06*** | (2006.01) |
| ***F02G 1/043*** | (2006.01) |
| ***F01B 11/00*** | (2006.01) |

(52) U.S. Cl.

CPC ... *E21B 4/14* (2013.01); *E21B 4/06* (2013.01); *F01B 11/00* (2013.01); *F02G 1/0435* (2013.01)

(58) Field of Classification Search

CPC ..... E21B 4/14; F01B 11/00; H02K 7/18; F28D 15/00; F16L 3/00

USPC ..... 173/114; 60/520, 641.2; 166/57, 61, 166/305; 175/315

See application file for complete search history.

(56) References Cited

U.S. PATENT DOCUMENTS

| | | | | |
|---|---|---|---|---|
| 3,782,859 | A | 1/1974 | Schuman | |
| 4,413,475 | A | 11/1983 | Moscrip | |
| 5,003,777 | A | 4/1991 | Berchowitz | |
| 6,488,105 | B1 | 12/2002 | Wilcox | |
| 2005/0097911 | A1 | 5/2005 | Revellat | |
| 2007/0245729 | A1* | 10/2007 | Mickleson | F01K 23/02 60/641.3 |
| 2008/0295511 | A1 | 12/2008 | Beale | |
| 2010/0223924 | A1* | 9/2010 | Cargill | F03G 7/04 60/641.2 |

FOREIGN PATENT DOCUMENTS

| | | | |
|---|---|---|---|
| EP | 0238337 | A2 | 9/1987 |
| JP | 2009281614 | A | 12/2009 |
| WO | 2008036814 | A2 | 3/2008 |

* cited by examiner

*Primary Examiner* — Nathaniel Chukwurah
(74) *Attorney, Agent, or Firm* — Michael Soderman

(57) ABSTRACT

In a direct drill bit drive for tools for comminuting brittle materials and penetrating into brittle materials by percussive impact on the basis of a heat engine operated with a gaseous working medium, the heat engine is a hot gas engine operating in accordance with a real Stirling cycle process.

15 Claims, 5 Drawing Sheets

(a)
(b)
(c) A-A
(d) D-D
(e)

13
19a
19
7'
3
14
A
21
22a
22b
22d
3g'
B
3i
2d
18
17
3a'
3b'
14b
15
22
22c
1
3h
2
13a
19
3a'
14'
D
15'
60
62
20'
18'
22d'
3
B
14c
13a
14b
14'
15'
63
62
61
13
3g'
43
30h
50
51
53
2e

DIRECT DRILL BIT DRIVE FOR TOOLS ON THE BASIS OF A HEAT ENGINE

CROSS REFERENCE TO RELATED APPLICATIONS

This application is the U.S. national stage of International Application No. PCT/DE2011/001878, filed on Oct. 21, 2011, and claims the benefit thereof. The international application claims the benefits of German Application No. DE 102010050244.8 filed on Oct. 30, 2010; all applications are incorporated by reference herein in their entirety.

BACKGROUND

1. Field of the Invention

The invention relates to percussive machinery used to comminuting brittle materials and penetrating into brittle materials. Preferred applications of the invention are deep drilling operations for the exploitation of oil- and gas wells, geothermal energy sources and generally for reconnaissance drilling into deep rock formations.

Further applications are for example the driving of tunnels and shafts and demolition work in environments without direct electric power supply. Furthermore, the invention can be used for percussive drilling and demolition with hand-driven tools.

2. Description of the Prior Art and Related Information

For drilling operations to depth of several thousand meters, the rotary drilling method is by far the most commonly used technique. This method is very suitable for the drilling in soft and semihard rock formations. The achievable drilling rate is however significantly decreased, if hard (crystalline) rock formations are encountered.

It is known for a long time that percussive drilling is much more suitable for crystalline hard rock, than with roller cone bits or rotating polycrystalline diamond compact (PDC) bits, whose mode of action is based on quasistatic uniaxial loading and shear, respectively. For example, the drilling rate of percussive machinery was found to be 10 times higher in granite than with roller cone bits. Further advantages of percussive drilling are low static loads (weight on bit, WOB) as well as a higher stability of the drilling process with respect to off-axis deviations.

Utilization of percussive drilling is state of the art in near surface drilling operations for a long time, for example for the excavation of blast holes in open-cast mining or for the near surface geothermics in hard rock formations.

For these purposes, a large number of apparatus and methods are described.

With respect to the location of the driving mechanism within the drill string, percussion drills can essentially be divided into two groups:

Top hammers (surface-operating) and down the hole (DTH) hammers. The former are mounted on a drill rig that remains above surface during drilling operation. The percussive action is transmitted in the form of longitudinal elastic waves through a stiff drill string. Due to the attenuation of these waves, the depth achievable with this method is usually restricted to less than 100 meters.

For deeper drilling depths DTH hammer are the only viable method. Here, the percussive mechanism is located directly behind the drillbit and is lowered town into the borehole together with the drill string. The energy required to drive the percussive mechanism is traditionally provided by pressurized air or water. However, a system purely based on pressurized air without drilling fluid would be problematic concerning the removal of the cuttings from the bottom of a deep borehole. A system based on a combination of surface-supplied pressurized air or gas as energy source for percussion and a thixotropic drilling fluid for the removal of the cuttings would require ever stronger compressors to overcome the quickly rising pressure at the borehole bottom—moreover, serious problems with the severalfold volume increase of the expanding gas on the way back to the surface would be encountered.

Conventional hydraulic percussion drills function via acceleration and deceleration of the water column inside the borehole. The abrupt stopping of the downward flow causes an impulse that is transmitted to the drillhead. As the inertia of the water column of the borehole increases linearly with drilling depth, maintaining the same percussive frequency would afford an ever increasing energy input. This requirement causes the energetic efficiency of this technique to become prohibitively low for large depths.

Moreover, percussive mechanisms that operate via direct throughput of drilling fluid in this or a similar manner are apt to extensive wear caused by the abrasive action of solid particles that are suspended within the fluid.

EP 0096 639 A1 presents a DTH-drill that is operating according to the principle of an internal combustion engine. Compressed air is alternatingly forced into an upper and a lower part of a cylinder chamber. Additionally, gasoline fuel is injected into the upper chamber. The fuel-air mixture ignites and the additional combustion pressure drives a striker piston towards an anvil. Exhaust gases and cooling air are to be transported back to the surface by appropriate ducts.

A similarly operating internal combustion hammer is described in DE 39 35 252 A1. It is comprised of a housing with concentric rows of multiple drill rods that are terminated by impact teeth at its lower end facing the rock to be drilled. The rods with the attached impact teeth are driven by combustion cylinders inside the apparatus that are sequentially fired to impact the rock. The device requires a number of supply pipes that carry pressurized air and fuel towards and exhaust gases from down-the-hole apparatus to the surface. Also electric cables are required for ignition and valve operation of the combustion chambers.

WO 2001/040 622 A1 discloses a device for generating pressure pulses in a borehole on the basis of a combustion heat engine which. The downhole pulser has a housing which accommodates a cylinder and a spring-loaded piston which are being arranged in that manner as to perform a combustion stroke of a combustible gas mixture. The combustion stroke causes a hammer being attached to the piston to impact an anvil. The components are reverted into their initial position by the means of springs. The combustion engine is supplied with hydrogen fuel and oxygen from two separate tanks. The intake of the combustion gases and exhaust of the resulting water steam is controlled by valves.

Further precussive drill bit drives on the basis of internal combustion engines are disclosed in SE 153256 C and GB 1350646 A.

DE 27 26 729 A1 and DE 30 29 710 A1 present a deep drilling device that is creating percussive pulses and is simultaneously set into a rotary motion by means of explosives or combustible gases.

All heat engines in the above-noted disclosures are operating without crank and crankshaft, as the expanding gas is acting directly on a percussive mechanism.

However, their required supply of gaseous or liquid fuel and oxidizers or explosives as well as the removal of the exhaust gases are very difficult to realize at large depths, as is the case for an electric powerline.

In deep drilling applications, in order to maintain the stability of the borehole, drilling fluids with a high gravity between 1.2 to 1.6 g/cm$^3$ are being employed.

The hydrostatic pressure at the bottom of a liquid column of depth h is increasing by $\rho \cdot g \cdot h$ with g being the gravitational acceleration and $\rho$ may be assumed as being approximately constant. Consequently, at large depths of several 1000 m high hydrostatic pressures of several hundred to more than 1000 bar can occur.

The operation of a heat engine at an internal pressure significantly lower than the hydrostatic pressure can be hardly imagined as in the most cases the percussive mechanism would also have to overcome this pressure difference. Moreover, the cylinder and other parts of the machine may be compressed or even collapse.

Conversely, pre-compression of the gaseous working of the engine at the surface can pose the risk of explosion.

This problem may be solved by a successive pressurization of the engine during the drilling operation or lowering of the drill string which may be accomplished by a pressure line from the surface or a pressure tank being integrated into the drill string. In deep wells >4000 m and/or heat engines with a large internal working space both solutions receive further restrictions.

A pressure tank pre-compressed to the full terminal pressure would be almost as hazardous as a similarly pressurized heat engine itself. Without pressurization, the required initial volume (i.e. the length of a compensation tank) might become unacceptably large with respect to the typical diameter of a drill string, as the Boyle-Mariotte law $p_1 \cdot V_1 = p_2 \cdot V_2$ applies.

Problem to be Solved

The task of the present invention is to provide a class of direct percussive drill bit drives on the basis of a heat engine that is adaptable to different forms of energy supply from an external source and that converts this energy efficiently and with low wear into an oscillating percussive motion. Devices of this class shall serve a variety of purposes, e.g. comminution of brittle materials, vertical and horizontal excavation in open pit or underground mining and drilling, from large scale to handheld machines.

The present invention shall especially provide a device for drilling in hard rock formations with low maintenance that is eventually powered by a conventional rotary drilling motor, which is in turn driven by the volume flow of the drilling fluid. The device shall remain operational to large depths and high hydrostatic pressures up to and above 1000 atmospheres at the bottom of the borehole.

SUMMARY

The problem is solved by the invention with characteristics as laid out by the claims 1 to 15. Claims 2 to 15 refer to preferential embodiments of the invention.

The invention provides a direct bit drive due to the action of a heat engine used to convert heat energy into percussive motion or pulses.

The heat engine works according to a real thermodynamic Stirling cycle of a quasi-enclosed gaseous working medium. The working gas is and is not exchanged with the environment and enclosed within the engine and a pressure exchange unit that is optionally incorporated within the drill string. Except from embodiments with external heat sources based on combustion, the bit drives claimed herein thus work without producing exhaust gases.

DETAILED DESCRIPTION

The bit drive consists of a preferentially cylindrically shaped pressure vessel enclosing the entire working space of the heat engine that is divided into different compartments. According to the active principle of a Stirling engine, the working medium is heated in one compartment and cooled in another one. Effective mechanical work results from a phase shift between the heating and expansion/cooling and contraction of the working medium, respectively.

The heat engines can be crankless Stirling engines with free moving power piston and displacer piston that are mechanically coupled by gas or metal springs (so called free piston Stirling) as well as thermoacoustic engines (also called laminar flow engines).

In the latter case, the role of the displacer piston is substituted by an oscillating pressure variation of the working gas within a standing acoustic wave in a suitable resonator.

The required thermal energy can be provided in both cases by an arbitrary external heat source, for example an electric resistance heater which is in direct contact to the working gas, an externally heated auxiliary fluid and a heat exchanger or a chemical reaction between liquid, gaseous or solid reactants that are continuously fed through a heat exchanger or combustion chamber. A particularly preferable embodiment is the utilization of frictional heat, provided by a friction pair made from suitable materials, that is driven by the rotation of a pneumatic or hydraulic turbine or drilling motor.

The tribcouple can be either in direct contact to the working gas within the engine volume or be thermally connected to the same by means of a heat exchanger.

In the case of a bit drive that is based on a free piston Stirling engine, percussive pulses are created at the cold end of the engine, either by compression of the working gas or by direct collision of the accelerated power piston or an additional striker piston with an anvil, which transmits them to the percussive bit.

In the case of a bit drive that is based on a thermoacoustic engine, percussive pulses are created via acceleration of movable pistons or other kind of movable, free surfaces at the cold end of the engine by the pressure oscillations in the resonator tube of the engine. They are either to the drill bit directly or after pulse intensification by an additional percussive mechanism.

As far as working principle and general construction of the Stirling engines themselves is concerned, the reader is referred to the thermodynamical and mechanical principles of the Stirling cycle that is well documented within the state of the art, particularly to US 2003/0196441 A1.

The above given description of the working gas as 'quasi enclosed' refers to requirement that for deep boreholes of several thousand meters, the mean pressure inside the engine requires to be adapted to the external hydrostatic pressure of the surrounding drilling fluid.

This problem is solved by a (quasi)-continuous feed or removal of the working gas into the working space of the engine by either one of two different methods disclosed hereafter.

In the case of smaller heat engines with a working space of a few ten liters and comparatively shallow drilling depths, pressure exchange vessels containing additional working gas that is pre-compressed at least to the initial mean pressure of the Stirling engine can be used. These are preferably located directly within the drill string directly above the percussive bit drive. As soon as the hydrostatic pressure of the drilling liquid becomes equal to that of the pre-compressed gas in the exchange vessel, working gas is injected into the engine, via displacement of a floating piston suspended inside the pressure exchange vessel. The process is similar to the action of a syringe. Working gas and drilling fluid remain separated at any time.

For larger drilling depths (>3500 meters) and engines with large working spaces, chemical reactions that generate or absorb working gas can be employed. Reactions that include the participation of solid reagents with a high specific molar conversion of working gas are particularly advantageous. Examples are the decomposition of azides or formation of metal nitrides. One preferred working gas is therefore nitrogen.

Figure 1:
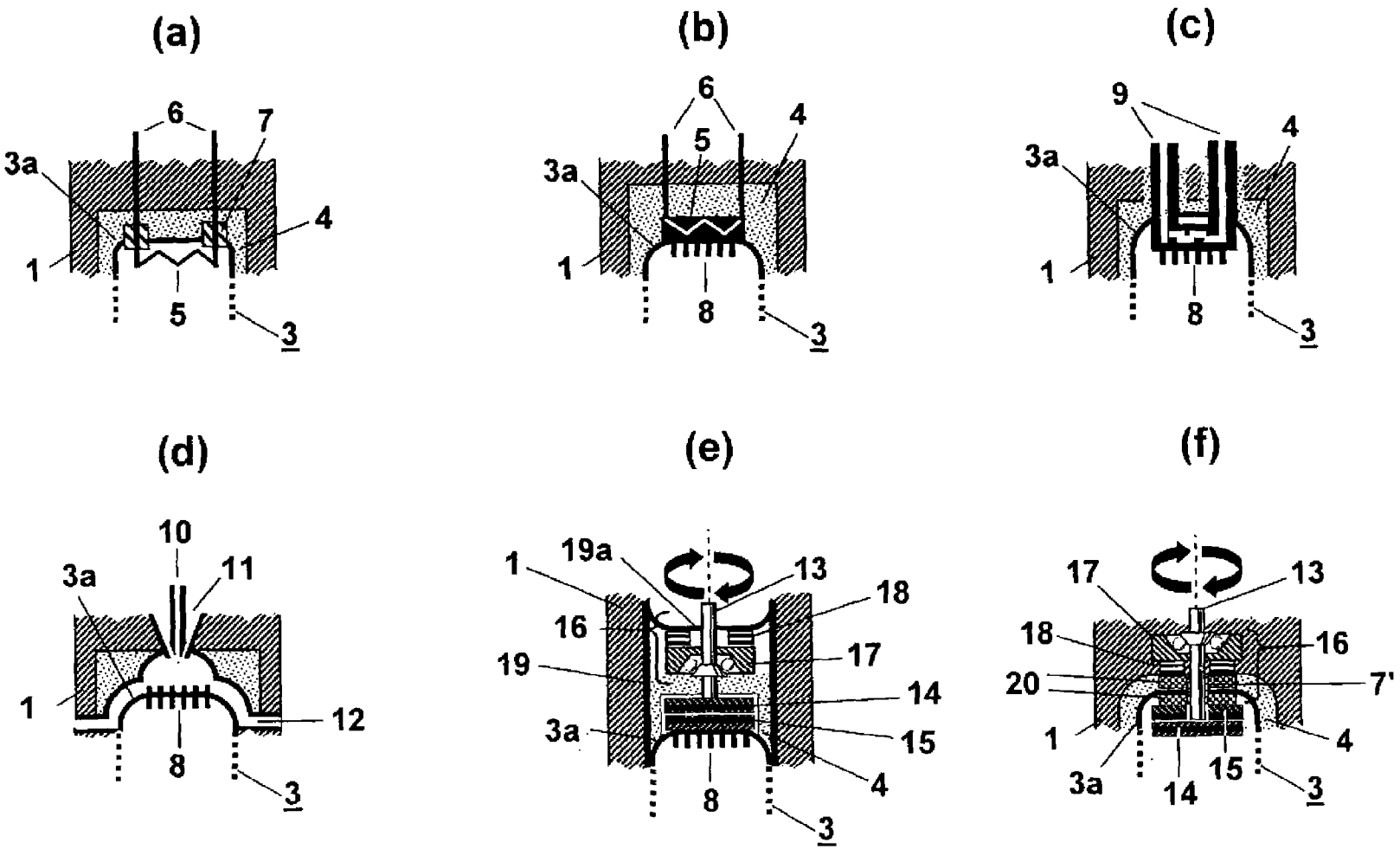
FIG. 1 (*a*) to (*f*) display different embodiments for the supply of thermal energy to a direct drill bit drive based on a free piston cylinder Stirling engine.
Figure 3:
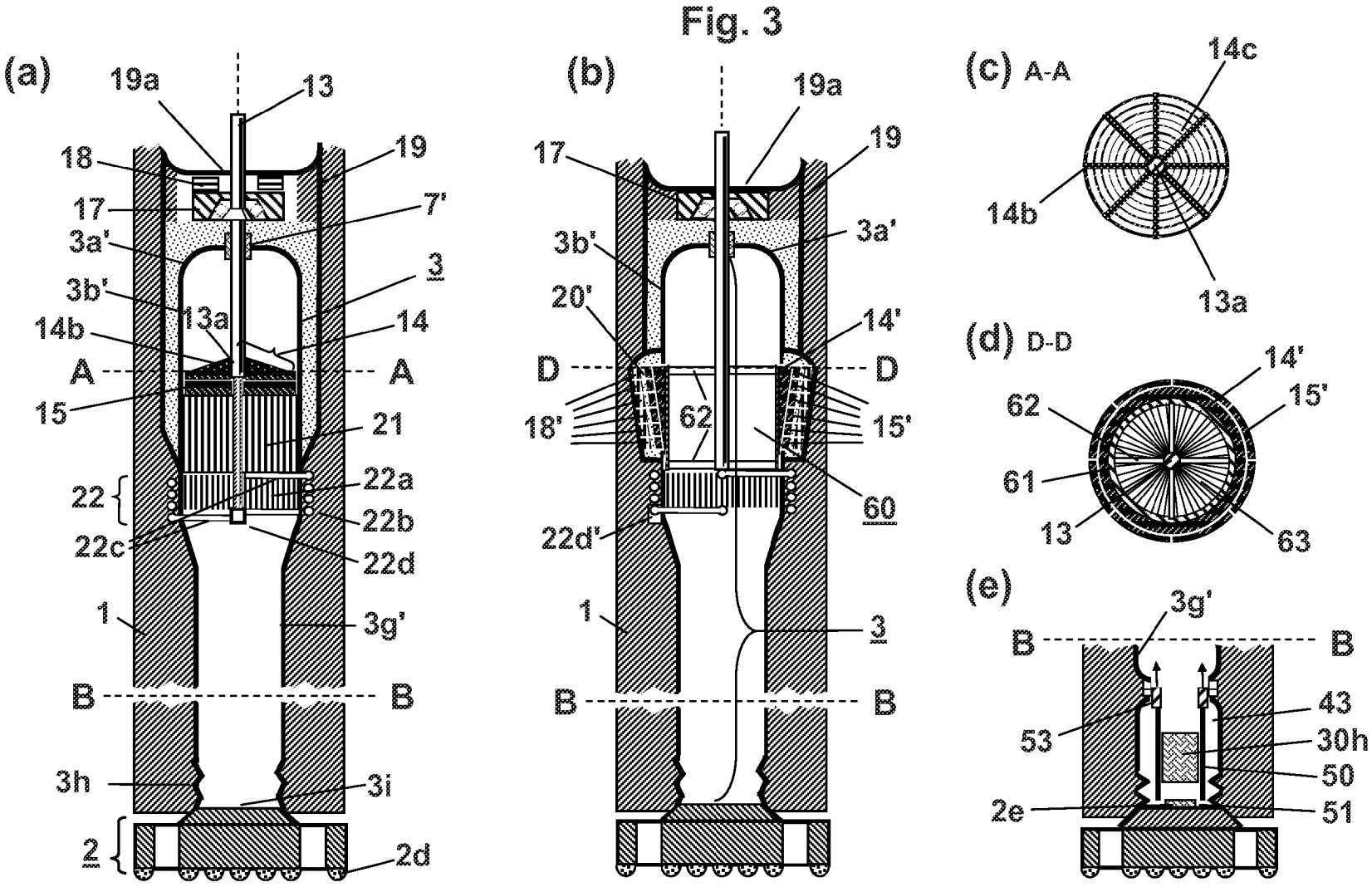

These variants 2 (*a*), (*c*) or (*d*) can be combined with either of the aforementioned thermal energy supply shown in FIG. 1 (*a*) to (*f*);

FIG. 3 (*a*) to (*e*) display different embodiments of a direct drill bit drive based on a thermoacoustic Stirling engine with a cylindrical pressure vessel 3. In such a thermoacoustic engine, the gaseous working medium is also subject to a real thermodynamic Stirling cycle. In the embodiments shown, the thermal energy is provided by mechanically driven friction pairs. The contact pressure required to create and control the friction between the sliding surfaces is provided by an external axial load. In FIGS. 3 (*a*) and (*c*) the sliding surfaces are disc-like and the contact pressure is parallel to the axial load. In FIGS. 3 (*b*) and (*d*) the sliding surfaces have a conical shape. Accordingly the direction contact pressure is inclined with respect to the axial load;

FIG. 3 (*e*) displays a percussive mechanism comprising an additional striker piston 30 *h;*

Figure 4:
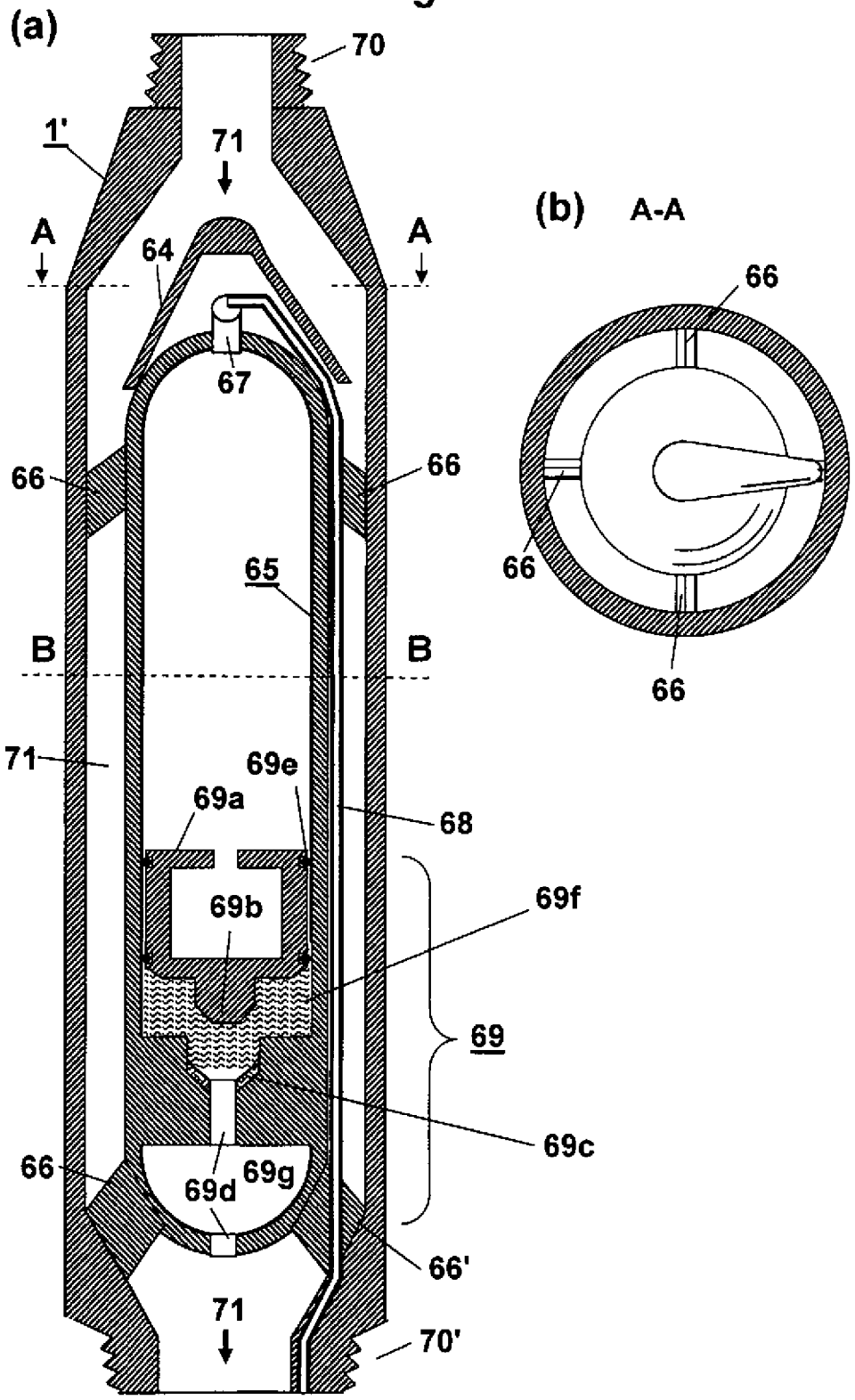
Figure 5:
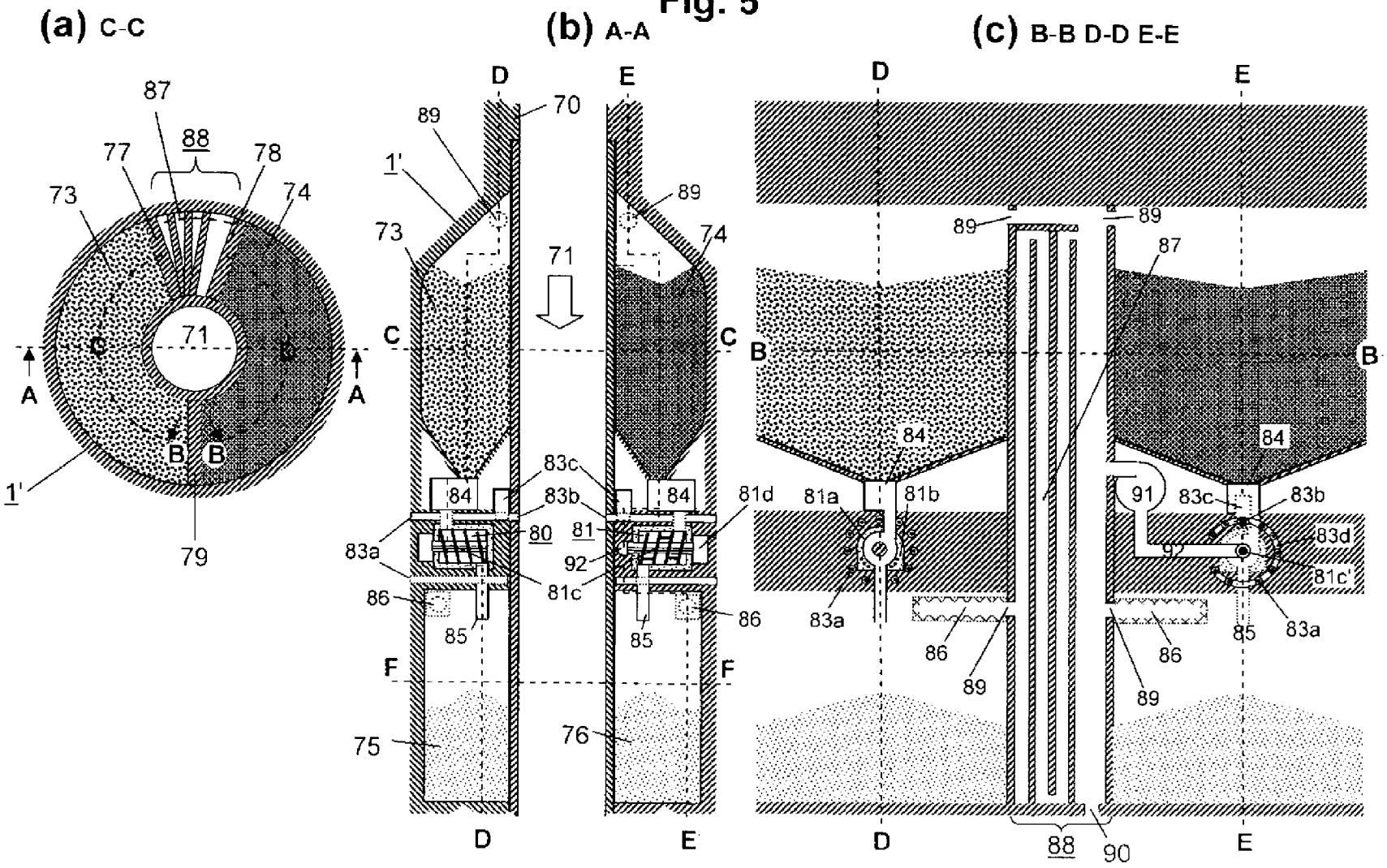

FIGS. 4 (*a*) and (*b*) display a lateral and an axial cross section through a gas-filled pressure exchange vessel, respectively, to be integrated into the drill string above the percussive bit drive for drilling to intermediate depths;

FIG. 5 (*a*) to (*c*) display different cross sections of a gas generation and absorbing unit to be integrated into the drill string above the percussive drill bit drive for drilling to large depths;

DETAILED DESCRIPTION OF THE PREFERRED EMBODIMENT

In the following, the invention will be described in more detail, exemplified by preferred embodiments shown in FIGS. 1-5, which relate to the application as percussive drilling device for the excavation of deep drilling holes, such as being required for the exploitation of oil, natural gas or geothermal energy.

In the following, the denomination of position by using "below", "lower" and the like, generally refers to the orientation of the drawings that is given by the reference signs as well as to the direction of the drilling action of the tool.

Figure 2:
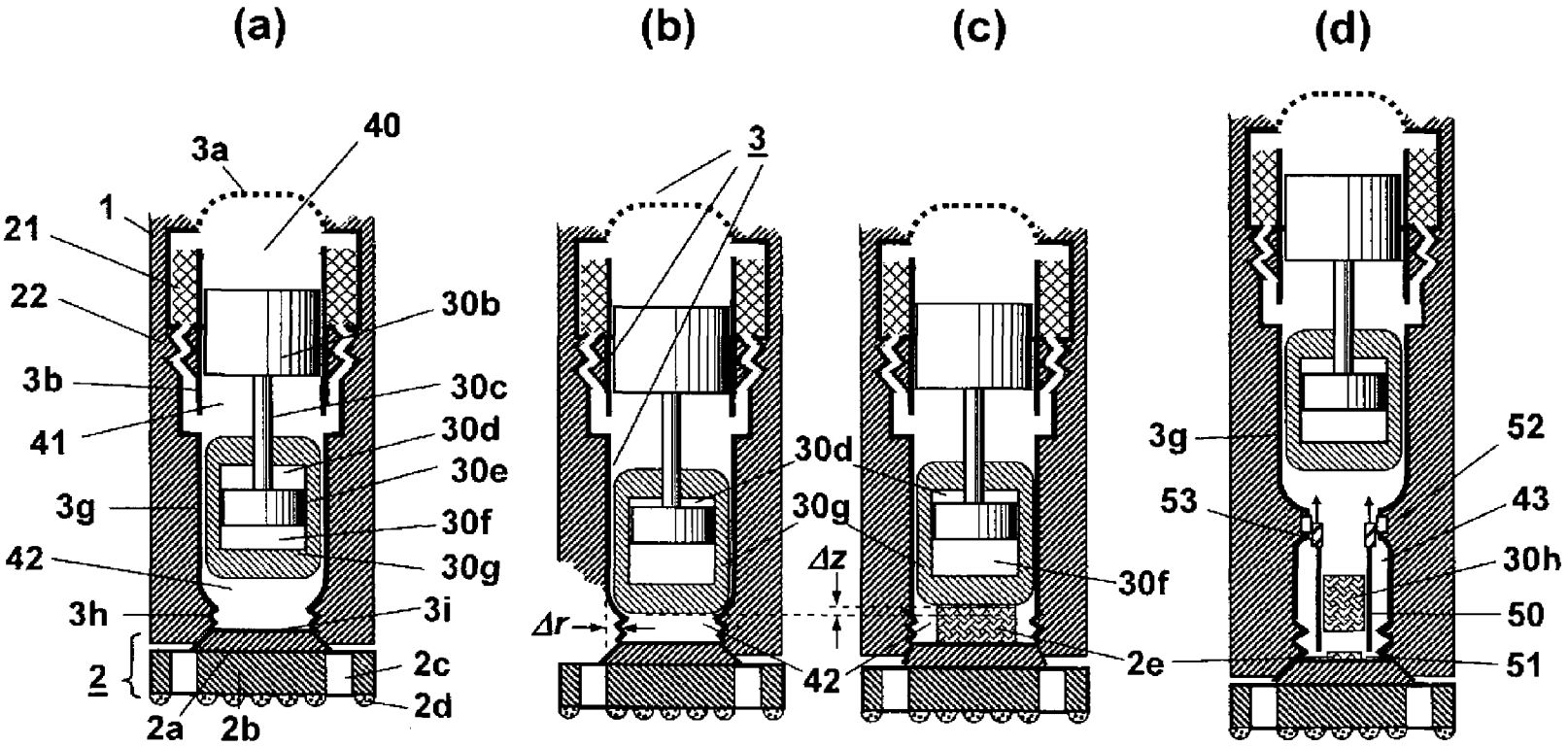
FIG. 2 (*a*) to (*d*) display different embodiments of a direct drill bit drive based on a free piston Stirling engine with displacer and power piston being coaxially arranged within a cylindrical pressure vessel 3.

FIGS. 1 and 2 show different embodiments which are all meant to be localized at the lower end of a not otherwise specified drill string.

All percussive bit drives and their possible combinations according to FIGS. 2 and 3 possess several common design features: A cylindrical housing 1 at the lower end of which a percussive drill bit unit 2, comprising a bit adaptor 2*a*, the drill bit 2*b* provided with flush channels 2*c* for chip removal.

The drill bit 2*b* can be a conventional percussion rock bit, such as for example being disclosed in EP 0 886 715 A1 or DE 196 18 298 A1, with inserts from tungsten carbide or another hard material 2*d*.

The bit adaptor 2*a* may comprise an indexing mechanism that causes a gradual rotation or rotary oscillation of the rock bit 2*b*, so that the inserts 2*d* act on different portions of the rock within two consecutive blows.

This rotation of the percussive drill bit unit 2 can be either coupled to its axial percussive motion, for example as taught in DE 27 33 300 A1, or being driven by the flow of the drilling fluid.

The housing 1 and the drill bit unit 2 are arranged coaxially with respect to the bore hole axis. The housing 1 encloses a cylindrical pressure vessel 3 that is rigidly fixed to the housing by suitable connector pieces not further shown.

In the case of a bit drive based on a free piston Stirling engine according to FIGS. 1(*a*) to (*f*) and FIG. 2 (*a*) to (*d*), the pressure vessel 3 consists of a heated cylinder head 3*a*, a displacer piston cylinder 3*b*, a power piston cylinder 3*g*, and a bottom end 3*i* that is attached to the bit unit 2 and is free to oscillate in axial direction by means of a connecting bellow 3*h*. All these parts are made of high temperature resistant and/or wear-resistant metal alloys.

In the case of a bit drive based on a thermoacoustic Stirling engine according to FIGS. 3 (*a*), (*b*) and (*e*), there is an upper and a lower resonator tube 3*b*' and 3*g*' representing the equivalents to the displacer piston cylinder 3*b* and power piston cylinder 3*g* in the free piston engine. The equivalent cylinder head 3*a*' is not heated in the presented embodiments of the thermoacoustic engine.

For both engine types, there is a clearance between the pressure vessel 3 and housing 1 through which drilling fluid can flow towards the flush channels 2*c*. In the most simple case, this space does not have any further compartments and serves as a channel itself, but it may also be accomplished by a suitable piping system that is accommodated between the pressure vessel 3 and housing 1. Moreover, devices for measuring and recording of operating parameters of the engine and the drill string such as temperature sensors, strain gauges, load cells and/or acceleration sensors as well as typical analytical devices commonly used in deep drilling, such as magnetometers, porosimeters, elemental analysis and the like may be accommodated in this location, along with their corresponding electronic circuitry and processing units.

In the following, the different embodiments for a heated cylinder head displayed in FIG. 1 are described in more detail. Components that are identical or equivalent in their purpose and design are addressed with identical reference signs which are valid for all subfigures of FIG. 1 (*a*) to (*f*) but may be displayed in only one of them in order to maintain clarity. All embodiments (*a*) to (*f*) are provided with a thermal insulation 4, consisting of a porous ceramic or mineral material, which is either intrinsically resistant against compression and/or mechanically stabilized by the pressure of a gas filling that is continuously adapted to the hydrostatic pressure of the drilling environment. Alternatively, thermal insulation can be provided by a rigid double wall that is internally evacuated in analogy to a dewar vessel.

FIG. 1 (*a*) is a schematic cross-sectional view of an electrically heated cylinder head 3*a* with an electric resistance heater 5 mounted at the inside of the pressure vessel 3. The heater is connected to an external AC or DC power source via electric leads 6. The leads run through gas-tight electric ducts 7 into the interior of the pressure vessel 3.

FIG. 1 (*b*) is a schematic cross-sectional view of an electrically heated cylinder head 3*a* with an electric resistance heater 5 mounted at the outside of the pressure vessel 3. Heating of the working gas at the inside of the cylinder head is accomplished by a heat conductor 8. It can be made from a material with higher thermal conductivity than the base material for the cylinder head 3*a* or the pressure vessel 3, respectively and is inserted sealingly into the latter.

In order to improve the heat emission into the working gas, the internal side of the heat conductor 8 can be provided with fins or other means that increase its contact area with the gas.

In both cases, electric current can be provided by a power source located at the surface in combination with electric ducts as disclosed in EP 257 744 A2, for example. Alternatively, a down-the hole electric generator that is driven by a mud engine, for example according to DE 3029523 A1, can be used.

FIG. 1 (*c*) is a schematic cross-sectional view of a cylinder head 3*a* that is heated by a hot fluid or a liquid or gaseous reaction mixture. Supply and removal of these media is accomplished via thermally insulated supply pipes 9 connected to a heat exchanger 8 that is preferably located inside the pressure vessel 3, in order to minimize heat losses. In order to maximize the heat transfer to the working gas of the Stirling engine, the heat exchanger may be spiral or meander-shaped and/or have fins or plate ribs. Heating media may be hot steam, thermal oil or liquid metals, receive their initial temperature by a heat source located above the percussive drill bit drive and are circulated from there to the engine and back. Preferred liquid metals are gallium and eutectic melts on the basis of gallium and/or indium, mercury, and molten alkali metals. Heat may also be created by means of an exothermic chemical reaction inside the heat exchanger, an example for a reactive mixture being hydrogen/oxygen which may be activated via a catalytic coating at the inner surface of the heat exchanger 8.

For deep drilling applications of this type of embodiment of the drill bit drive, those media and mixtures would be preferred which do not form permanently gaseous reaction products. The release of gas bubbles into the borehole and their strong expansion on their way to the surface could cause an interruption of the drilling fluid circulation and other serious complications within the drilling process. The water vapor which is produced from the reaction of hydrogen and oxygen, however would rapidly condense to liquid water due to the cooling action of the drilling fluid.

FIG. 1 (*d*) is a schematic cross-sectional view of a cylinder head 3*a* that is heated by a burner with a direct combustion flame. This embodiment is not a preferred one for deep drilling applications, but may provide a basis for compact and powerful percussion machinery for horizontal and near-surface drilling, possibly also for handheld drill hammers, at places where no electric power supply is available.

The gaseous or liquid fuel is injected into the burner via the supply pipe and nozzle 10, while the oxidating component—which in the most simple case is air—is provided by an intake manifold 11. The fuel-air mixture can be ignited e.g. by electric spark, the generator for which is not further depicted. The heat is, in analogy to the aforementioned embodiments, transferred to the interior of the pressure vessel 3 via a heat conductor 8. For an improvement of efficiency of the heat transfer, the hot combustion gases may be channeled along the cylinder head before leaving the apparatus via an exhaust 12.

FIGS. 1 (*e*) and (*f*) display schematic cross-sectional views of another variant for the supply of heat energy to the engines, i.e. frictional heat. It is provided by a friction pair comprised of a rotating disc 14 and a stationary disc 15, that are either located outside (FIG. 1 (*e*)) or inside (FIG. 1 (*f*)) the pressure vessel 3. These embodiments are particularly well suited for deep drilling applications, because the friction pair can be driven by a conventional down-the-hole mud motor or turbine which are in turn being propelled by the circulating drilling fluid, as is customary in established rotary drilling techniques. The rotational motion and torque generated by these motors is transferred to the rotating friction disc 14 via a drive shaft 13 affixed to it. The normal force by which the rotating disc 14 is pressed against the stationary counterdisc 15 is provided by a pretensioning jig 16. The latter consists of a bearing 17 that has the purpose to stabilize the drive shaft 13 in radial direction and allows the introduction of axial forces along the shaft. In the present embodiments, 15 is represented by a tapered ball bearing, but it may also realized by many other forms of bearings, such as (tapered) roller bearings, needle bearings or frictional bearings.

The normal load on the friction pair 14/15, and hence the frictional drag and the dissipation of heat can be varied and controlled via expansible actuator elements 18, according to the momentary requirements of the percussive drilling process.

Discrete embodiments of 18 can be an assembly of either hydraulic cylinders, piezoelectric or magnetostrictive elements or spindle drives with electric motors that are clustered around the drive shaft 13.

In the embodiment according to FIG. 1 (*e*), the (controllable) normal load is exerted on the friction pair by imparting a compressive force onto the drive shaft 13 between bearing 17 and the rotating disc 14, using the aforementioned expandable actuator elements 18. This compressive loading is counteracted by a load frame 19, which is rigidly connected to the pressure vessel 3. In this particular example, the load frame 19 represents a direct continuation of the hull of the cylindrical pressure vessel 3, so that the cylinder head 3*a* can be considered as an intermediate bottom. A second intermediate bottom 19*a* picks up the load that is created by the expandable actuator elements 18 while prestraining the lower portion of drive shaft as previously mentioned.

In the embodiment according to FIG. 1 (*f*), the normal load is exerted on the friction pair by imparting a tensile force onto the drive shaft 13 between bearing 17 and the rotating disc 14. The force is counteracted by compression elements 20, located between the stationary friction disc 15 and the expandable actuator elements 18 inside and outside of the hull of the pressure vessel 3.

The mechanical loading and the proximity to the hot friction pair requires the material of these compression elements 20 to have high compressive strength and sufficient shear strength, in combination with a high thermal stability and low thermal conductivity, the latter in order to reduce the loss of thermal energy out of the cylinder head. These requirements can for example be fulfilled by zirconia-based ceramics. In order to additionally reduce the thermal losses, the compression elements 20 can possess hollow channels or a honeycomb structure, with channel axes preferably oriented parallel to the axis of compressive loading. As the friction pair 14/15 in the embodiment depicted in FIG. 1 (*f*) is located inside the cylindrical pressure vessel 3, the drive shaft is led through a gas-tight shaft sealing 7'. It seals off the difference between the dynamic pressure amplitude of the working gas and the static pressure outside of the pressure vessel 3, such as the gas pressure in the porous thermal insulation layer 4, for example. This difference may be small compared to the absolute hydrostatic pressure in the borehole, to which the average gas pressure within the engine will be adapted to. This aspect of the invention has been already mentioned and will be explained in another paragraph of this disclosure in more detail.

In the following, the heat conduction in—and choice of materials for the friction pair 14, 15 is discussed in more detail, as it will have a large impact on the effectivity of the frictional heating mechanism.

From FIG. 1 (*e*) it is evident that only that part of the frictional heat that is conducted through the stationary disc 15 towards the cylinder head 3*a* will contribute to the performance of the Stirling engine, while conduction of heat in radial direction and through the rotating disc 14, away from the interface between 14 and 15 is representing a loss.

In the embodiment shown in FIG. 1 (*f*), the heat transfer to the working gas takes place at the circumferential surface of both discs, as well as the front face of the rotating disc 14, whilst conduction of heat from the stationary disc 15 through the cylinder head 3*a* represents a loss.

As the temperature at the cold end of the engine is fixed to that of the drilling fluid at the bottom of the borehole but efficiency η of the thermodynamic Stirling cycle increases with the temperature difference between the hot and cold end, the friction pair 14/15 should be as hot as possible, which has in turn to be considered with respect to the choice of materials for these discs.

The friction surfaces must consist of a material with high wear resistance and warm strength, a high thermal stability and a high coefficient of friction. In DE 44 38 455 C1 and in G. H. Jang et al.: "Tribological Properties of C/C—SiC Composites for Brake Discs", Met. Mater. Int. (2001), Vol. 16, No. 1 brake discs made of carbon/carbon-silicon carbide composites (C/C—SiC) with a thermal stability up to 1300° C. and a high thermal conductivity are disclosed. The body of that friction disc which is responsible for the heat transfer to the working gas (i.e. 15 in FIG. 1 (*e*) and 14 in FIG. 1 (*f*), see above) can be made entirely out of this type of material. The body of the corresponding counter disc consists preferably of a material with similar properties except for its thermal conductivity, which has to be low in order to limit thermal losses. For example, a zirconium oxide-based ceramic may be used as a base material for this disc. In order to optimize the friction at the frictional interface, the disc may be additionally coated or laminated by another material that has these desired properties. It may also consist of a composite of a material with low thermal conductivity and a friction material, where the volume fraction of the latter increases gradually towards the frictional interface. In particular, with reference to FIG. 1 (*f*), the stationary disc 15 and the compression elements 20 at the inside of the cylinder head 3*a* can be made as one integrated part according to this design principle.

FIG. 2 (*a*) to (*d*) display schematic cross-sectional views of three different embodiments for a percussive drill bit drive on the basis of a free-piston Stirling engine. FIG. 2 (*b*) depicts a certain position/a certain instant within the work cycle of the engine shown in FIG. 2 (*a*), while FIGS. 2 (*c*) and (*d*) show two different construction variants to it.

In all subfigures (*a*) to (*d*), identical reference signs refer to components that are identical or equivalent in their purpose and design. Where appropriate and sufficient for the following explanations, some reference signs therefore are shown in the drawings only once.

All three embodiments have several construction features in common: A displacer piston 30*b*, to which a piston rod is affixed, which is movably inserted through a sealed bore through the upper end of the power piston 30*g*.

At the end opposite to the displacer piston, another small piston 30*e* is fixed which can sealingly move in an additional cylinder inside the power piston. The small piston 30*e* divides the small cylinder into two compartments, 30*d* and 30*f* representing gas spring elements. In the following, the term 'axial' refers to the common axis of this piston assembly.

The lower end of the power piston is facing a collision space 42, also acting as gas spring. The bottom of the collision space (3*i*) is free to move without leakage of working gas, for example via a hermetically-sealed bellow 3*h*.

In FIG. 2 (*b*) and FIG. 2 (*c*) two possibilities to obtain an oscillating percussive action from the described Stirling engines that differ only within a small number of construction features are depicted.

In FIG. 2 (*b*), geometry and volume of the collision space is chosen in a way, that the motion of power piston 30*g* is decelerated and comes to a halt by pure compression of the working gas and without colliding with the bottom 3*i* or the tapered lower portion of the wall of working cylinder 3*g*.

The average pressure within the collision space 42 is identical to that within the working spaces 40 and 41. As will be described in more detail further below, this overall average gas pressure is adapted to the hydrostatic pressure of the drilling fluid at the bottom of the borehole so that an optimum performance of the drill bit drive is achieved for every level of depth.

Close to the bottom end of collision space 42 the diameter of the cylinder is reduced by 2×□r (FIG. 2 (*b*)), which leads to an increase in compression rate of the working gas when the power piston 30*g* is approaching the end of its downward stroke. The bottom plate 3*i*, which is free to oscillate in axial direction due to the stretching an contraction of the bellow 3*h* is thus rapidly accelerated downwards, driving the percussive drill bit unit 2 attached to it.

It should be noted that due to the phase lag inherent to any Stirling engine, the displacer piston 30*b* is still in downward motion at the instant displayed FIG. 2 (*b*). The power piston 30*g*, after having passed it lower dead center is pushed and pulled upwards again due to the compressed gas in the lower collision space 42 and the upper compartment of the small cylinder 30*d* in conjunction with the inertia of the displacer piston 30*b*. In the part of the work cycle that follows next, the volume in space 41 is diminished, due to the continued downstroke of the displacer piston and beginning upstroke of the power piston. Cool gas flows through cooler 22 and regenerator 21 into the hot end of the pressure vessel 40. The temperature of the cooler 22 is maintained by a flow of the drilling fluid at ist outside. The regenerator 21 is conceptuated so that it is in complete thermal exchange with the working gas. This means that the cross sections of its pores and channels through which the working gas flows correspond to one or a few times the thermal penetration depth of the regenerator material at the typical frequencies of the engine.

Reference is now made to FIG. 2 (*c*), where an additional anvil 2*e* is located in the collision space 42, rigidly connected to the bottom 3*i*. Geometry and volume of the collision space are chosen so that it acts as a gas spring with too low spring constant. Consequently, the power piston 30*g* does not come to a halt due to the action of the spring, but rather collides with the anvil 2*e*. This corresponds to an enforced lower dead center, which is displaced upwards by a distance □z with respect to the 'regular' position in FIGS. 2 (*a*) and (*b*).

The collision between power piston and anvil gives rise to two elastic waves, traveling away from each other in opposite direction. The elastic wave that is emitted into the power piston 30*g* is reflected at the surface to lower working space 30*g* of the small cylinder. Its momentum thus contributes to the upstroke of the power piston. The other elastic wave emitted into the anvil 2*e* travels downwards into the drill bit unit 2 and finally acts on the rock to be crushed.

Due to the significantly lower compressibility and higher sound speed of the colliding bodies, this type of stress wave has a significantly higher amplitude (in terms of force per unit area) but a reduced time of action compared to the gas pressure pulse with associated acceleration of the lower bottom plate 3*i* previously discussed for FIG. 2 (*b*).

In the embodiments displayed in FIGS. 2 (*a*) and (*b*) which were so far described, the percussive pulse is created by a interaction of the power piston 30*g* with other components of the direct bit drive at an instant of the working cycle of the engine when the power piston is approaching its lower dead center, i.e. when its downward velocity is approaching its minimum.

FIG. 2 (*d*) displays a schematic cross-sectional view of another embodiment of the invention that facilitates the momentum-transfer from the power piston to take place at an earlier instant of the work cycle, i.e. when the power piston is still at higher speed. This type of percussive drill bit drive is equipped with an additional striker piston 30*h* that can oscillate within a cylinder 50 built into an extended collision space 43. An anvil 2*e* is located at the bottom end of the striker piston cylinder 50 and both are firmly attached to the bottom plate 3*i* (viz. FIG. 2 (*a*)). Further, openings 51 at the bottom end of the cylinder allow the flow of working medium into and out of the outer volume of the extended collision space 43. In order to minimize viscous losses of the gas flow, the openings can occupy a large fraction of the circumferential area of the striker piston cylinder at this position.

The diameter and hence the cross section of the striker piston cylinder 50 is smaller than that of the power piston cylinder 3*g*. The gas being displaced by a downstroke of the power piston (30*g* viz. FIG. 2 (*a*)) thus accelerates the striker piston to a higher speed than that of the power piston itself. The height and hence the volume of the cylinder 50 is chosen so that the striker piston 30*h* hits the anvil 2*e* is at mid position between its upper and lower dead center, i.e. when it has its highest speed. Up to this instant, the upper end of the striker piston cylinder 50 is sealed against the cold working space of the engine 41 (viz. FIG. 2 (*a*)) by a control valve 53 that is driven by an actuator unit 52. In order to minimize viscous losses, the flap of the valve 53 can have the shape of a short cylinder or ring, with a corresponding annular orifice for the gas flow. Upon further downward travel of the power piston, the valve 53 is opened, which can be triggered for example by a signal-pickup of the collision of the striker piston with the anvil and executed by a simple electric or pneumatic mechanism. The actuator unit 52 is however preferably connected to a process computer which receives data on the instant speed and position of the power piston 30*g*. By regulating the valve position and the timing of its complete opening or closing, the entire dynamics of the engine may be controlled.

The opening of the valve 53 during the second half of the downstroke of the power piston is indicated in FIG. 2 (*d*) by arrows pointing in upward direction. Due to this opening, the working gas displaced by the continued movement of the power piston 30*g* is now compressed directly into the outer volume of the extended collision space 43 which acts as a gas spring. The volume of 43 is chosen so that the lower dead center of the power piston is slightly above the tapering at the bottom of its cylinder 3*g*. In the following part of the work cycle of the engine, valve 53 is closed again and the compressed gas in the volume 43 pushes the striker piston 30*h* upwards again. Partial opening of the valve 53 will provide a by-pass and may be used to control this process, so that the striker piston is exactly at its upper dead center again, when the power piston is half-way down and the cycle can start again.

Moreover, the operation and frequency of the free piston Stirling engine can be controlled and stabilized by additional means, such as displacer phasin mechanism for the combination of a power piston 30*g* with a small internal piston 30*e* as taught in GB000001503992A.

It is comprehensible to those skilled in the art that the embodiments presented herein are not exhaustive with respect to the utilization of a free piston Stirling engine for a percussive drill bit drive in the sense of the invention.

For example, WO 1995 029 334 A1 discloses a device for operating and controlling a floating-piston Stirling engine which creates a pressure difference of the working gas between a high pressure and a low pressure reservoir. This pressure potential may in turn be used to power a pneumatic hammer at the lower end of the Stirling engine.

FIGS. 3 (*a*) and (*b*) display a schematic cross-sectional views of two further preferred embodiments of the invention, providing direct percussive drill bit drives that are based on a thermoacoustic engine.

Again, components that are identical or equivalent in their purpose and design are addressed with identical reference signs which are valid for all subfigures but may be displayed in only one of them in order to maintain clarity.

In both embodiments, the pressure vessel 3 common to all direct drill bit drives disclosed herein, is of mainly cylindrical shape and forms an acoustic resonator tube, synonymously addressed with 3.

In the embodiment schematized in FIG. 3 (*a*) the required thermal energy is provided via friction in a similar manner as described previously (for reference signs No. 17, 18, 19 and 19*a* reference is thus made to FIG. 1 (*e*)): Mechanical energy is provided by rotation and torque of a drive shaft 13 and converted to heat by an axially loaded friction pair comprised of a rotating—(14) and a stationary friction disc 15. The function of and requirements for the shaft sealing 7' has been already described within the explanations to FIG. 1 (*f*).

In the embodiment depicted in FIG. 3 (*b*) the friction pair has the shape of two nested conical cylinders 14' and 15', so that the sliding motion is tangential and the normal loading on sliding surfaces has a radial and an axial component with respect to the axis of the drive shaft 13.

A more detailed description of the friction systems is given via reference to FIGS. 3 (*c*) and (*d*) further below.

The rejection of heat is accomplished in both engines by a low temperature heat exchanger system 22 through which a cooling liquid is pumped. Inside the pressure vessel, the heat exchanger is comprised of thin hollow struts or lamellae 22*a*, oriented parallel to the axis of the engine to provide a good thermal contact to the working gas. Gaps between the struts allow for the oscillating flow of the working gas with as low as possible viscous or turbulent losses. In order to enable the struts to be sufficiently thin without being clogged, the cooling is preferably provided by a coolant circulating in a closed system and not directly by the viscous and particle-loaded drilling mud.

Possible coolants are liquid metals or metal alloys such as gallium, eutectic alloys on the basis of gallium-indium or mercury as these have a low viscosity, high boiling points and a high thermal conductivity. More conventional coolants such as silicone oils, perfluorated (hydro)carbons or water with additives in order to increase the boiling temperature may also be used. The circulation of the coolant is accomplished by a pump 22*d*, that is preferably driven by a direct extension of the drive shaft 13 located below the heat exchanger 22 in the axis center of the pressure vessel 3. Alternatively, as shown in FIG. 3 (*b*), the coolant pump (22') can be located outside the pressure vessel and for example be driven by an electric motor not displayed.

The coolant rejects the heat absorbed from the working gas in the interior of the pressure vessel within a second heat exchanger 22*b* located outside of the pressure vessel and in thermal contact with the drilling fluid. In the particular example depicted in FIGS. 3 (*a*) and (*b*), it has the shape of a coiled pipe surrounding the pressure vessel 3. A further component of the heat exchanger system 22 is the coolant manifold 22*c* providing connection between the heat exchanger struts 22*a* and the external cooler 22*b*. Struts and manifold are arranged and connected in a manner that facilitates a homogeneous cooling of the working gas over the entire cross section of the resonator tube 3. Moreover, a coolant reservoir not shown in the Figures is connected to the cooling system to compensate for the thermal expansion of the coolant as well as its compression or decompression while the drill bit drive is lowered into or pulled out from the well, respectively. This reservoir is preferably located between the housing 1 and the pressure vessel 3. The thermoacoustic oscillation of the working gas is stimulated within the regenerator 21 which provides a zone of a steady thermal gradient between the temperature of the hot friction pair 14/14'-15/15' and that of the cooling system 22.

The working gas experiences an oscillating flow through the regenerator. This happens in a manner that the direction of flow is toward the (upper) hot end of the resonator tube 3*b'* with rising pressure and towards the cold (lower) end of the resonator tube 3*g'* with falling pressure.

It should be noted for the sake of completeness, that, according to the state of the art (see e.g. US 20030196441A1), when the thermoacoustic Stirling engine is a single-stage standing wave-type engine with a straight resonator tube (≡pressure vessel 3), the regenerator 21 must provide an incomplete local heat exchange with the working gas in order to maintain the necessary phase lag between its volume flow and the thermal expansion/contraction. A regenerator of this type is commonly called 'stack' and comprises plates or struts of a solid material with a high specific heat and a characteristic mutual separation of several times the thermal penetration depth of the particular working gas at the given frequency of the resonant oscillation.

In contrary to the friction pairs displayed in FIGS. 1 (*e*) and (*f*) that are suitable for free piston type stirling engines with a heated cylinder head, the heating elements for thermoacoustic engines—in the discrete embodiments displayed in FIGS. 3 (*a*) and (*b*) also realized by friction pairs—are to be preferably located at a certain axial position within the resonator tube 3. They must therefore enable an oscillating axial flow of working gas through them with desirably low viscous and turbulent losses. This requirement is fulfilled for the embodiment depicted in FIG. 3 (*a*) by the utilization of friction discs with axial channels or a set of annular gaps. FIG. 3 (*c*) is a cross section view of the rotating friction disc 14 as indicated by A-A in FIG. 3 (*a*). In this discrete embodiment, the rotating friction disc 14 is essentially comprised of a set of nested friction rings 14*c* that are connected by radial struts or spokes 14*b* and may be further reinforced by additional elements not shown.

The upper friction disc 14 is attached to the drive shaft 13 via a hub 13*a*. Due the triangular stiff shape of the spokes 14*b* (viz. FIG. 3 (*a*)) an axial load, that is produced by the expandable actuator elements 18 and transmitted via bearing 17 and drive shaft 13 can be exerted on the friction pair.

The lower, fixed friction disc 15 is also comprised of friction rings, positioned congruent to those of the upper rotating disc 14 in order to create a continuous friction path. In contrary to the rotating disc 14, with the aforementioned triangular spokes, the fixed disc 15 has only radial flat reinforcements. It is mechanically and thermally attached to the regenerator stack 21, which is in itself rigid and also rigidly connected to the wall of the pressure vessel 3. It receives a part of the heat from the friction pair and acts also as a support for the torque and the aforementioned axial load exerted on the friction pair to control and maintain a high frictional force.

If the coolant circulation is driven by a pump 22*d* that is located within the pressure vessel 3 as shown in FIG. 3 (*a*), the stationary friction disc 15 and the regenerator 21 are provided with an axial channel for the extended drive shaft 13.

Materials to be used for the friction pair could be silicon carbide- or carbon-fiber reinforced ceramics or composites with a high friction coefficient and a good thermal conductivity—which have already been introduced in the explanations to FIGS. 1 (*e*) and (*f*). It should be noted however, that the specific mechanical loading conditions are more severe in the present case because of the necessity to use perforated friction discs that enable the passage of working gas through them.

In FIGS. 3 (*b*) and 3 (*d*) another variant of a thermoacoustic drill bit drive is shown, where this potential problem is circumvented and an unperforated, massive friction material can be used again. In this embodiment, frictional heat is generated within a tapered cylindrical surface that surrounds a rotating heater and generator stack 60. It comprises a hollow metal drum 61 that is rigidly fixed to the drive shaft 13 by stiff spokes 62. In addition to the spokes, a thermoacoustic stack is provided by a radial assembly of heat conducting plates 63. At the circumference of the drum 61 a tapered layer of a friction material 14' is attached with good mechanical and thermal contact to the drum. The resulting rotating heater and regenerator stack 60 is seated in an assembly of segmented friction elements 15'. Each element can be individually pressed against the rotating friction material 14' by means of corresponding actuator elements 18'. Thermal insulation between the friction elements 15' and the actuators 18' is provided by a segmented insulation layer 20' from a compression resistant material. In a similar manner as previously described for FIG. 1 (*e*), the axial trust on the drive shaft 13 that results from the radial inward pushing of the actuator elements is counteracted by a bearing 17 and transferred into a load frame construction consisting of components 19 and 19*a*.

Due to the conical shape of the frictional interface between 14' and 15', the relative velocity of the sliding surfaces differs within axial direction, which in turn leads to different rates of heat dissipation and a thermal gradient along the axis of the rotating regenerator stack 60. The heat conducting plates 63 act therefore as heater and regenerator elements at the same time. The thermal gradient can be enhanced and controlled via the application of different normal loads along the drum axis, corresponding to a diversified activation of the actuator elements 18'. Because the frictional heat is produced at the circumference of the heater and regenerator stack 60, the heat conducting plates 63 are getting cooler towards the cylinder axis and the drive shaft 13. However, due to their radial arrangement, also the distance between them becomes smaller towards the axis of the resonator tube, so that the specific heat transmission to the working gas increases in the same direction. The angle between neighboring plates 63 and their number should thus be chosen in a manner that both effects cancel out each other during the optimum operating conditions of the engine and a nearly homogeneous heating of the working gas over the cross section is achieved.

The percussive action of the thermoacoustic engines depicted in FIGS. 3 (*a*) and (*b*) is achieved via a movable bottom plate 3*i* at the lower end of the resonator tube 3 to which the percussive drill bit unit 2 is attached. Both are excited to an oscillatory motion in phase with the pressure oscillations of the standing acoustic wave inside the resonator tube 3. Their mobility is achieved via a bellow 3*h* which should however not understood as an exclusion of equivalent solutions, such as a sealed movable piston for example. The maximum possible displacement of these elements is only a small fraction of the entire height of the resonator tube 3, preferably 0.1 to 3%. The actual amplitude of the oscillatory motion of the bottom plate 3*i* and percussive bit unit 2 during operation of the bit drive is usually smaller. It is the sum of the clearance between the hard metal inserts 2*d* and the borehole bottom and the penetration depth into the rock for each blow.

According to the theory of standing acoustic waves, the amplitude of the pressure oscillation of the working gas is at a maximum at both closed ends of a resonator tube. For a resonator tube that has one closed and one open end, the velocity amplitude of the working has is at maximum at the open end, while the pressure oscillation has a nodal point.

In the present case of a bottom plate with restricted movability a mixed form of both phenomena will occur. However, due to the small displacement of the bottom plate 3*i*, the character of the standing acoustic wave in the discrete embodiments will be much closer to that of a tube closed at both ends.

Reference is now made to FIG. 3 (*e*) showing a schematic cross section view of an additional percussive mechanism. As indicated by the line B-B, it can be flanged to the bottom of either of the two aforementioned thermoacoustic drill bit drives to provide an enhancement of the amplitude of the percussive pulses.

It is easily recognizable to the reader that the mechanism is identical to that shown in FIG. 2 (*d*) with respect to its function and design, however it should be noted that this is not necessarily the case with respect to its apparent proportions and the dimensioning of its components.

Moreover, with respect to all types of percussive drill bit drives disclosed herein, it remains to be noted that these are to be operated at low axial force as their percussive action declines with increasing weight on bit (WOB), as is the case for many conventional percussion drills.

It has been already mentioned that for utilizing the heat engine-based direct drill bit drives according to the present invention in deep drilling applications, the average pressure of the working gas is to be adapted to the hydrostatic pressure of the drilling fluid that is surrounding the engine by means of a quasi-continuous supply or removal of the working gas into its working space.

In the following, this aspect of the invention will be explained in more detail.

A steady equilibration of the average internal with the increasing external pressure is necessary during the drilling operation itself, but especially in the case when the drill hammer is pulled up from or lowered down into a pre-existing borehole, which is frequently necessary in deep drilling applications.

Assuming a specific gravity of a typical drilling fluid of 1.2 g/cm$^3$, the pressure change will be approximately 0.12 MPa per meter.

For the appropriate design of a corresponding pressure equilibration unit, the pressure increase or decrease during the lowering or withdrawal of the drill string (displacement velocity: several 100 m/h) during a round trip are by far more important than that during the drilling itself (drilling rate usually not more than a few to a few ten meters per hour).

In the case of compact Stirling or acoustic engine based bit drives with a comparatively small working space of in the range of a few liters, supply and removal of working gas may be accomplished by a compensation tank that is integrated within the drill string above the drill bit drive and the primary powering unit, e.g. a mud motor. This pressure exchange vessel encloses a gas volume that is at least compressed to the initial average pressure of the Stirling engine. When reaching a depth where the external hydrostatic pressure exceeds that of the pre-compressed gas, the gas volume in the pressure exchange vessel is reduced by an inward flow of drilling fluid until a new equilibrium between the tank, the engine and the environment is reached. In order to prevent contamination of the working gas and corrosion of the hot engine, an embodiment of this principle must include means to avoid direct contact between the gas and the drilling fluid.

FIG. 4 (*a*) shows an cross sectional view of a pressure exchange unit according to this aspect of the invention. A pressure exchange vessel 65 is surrounded by a cylindrical housing 1' and connected rigidly to it by means of streamlined struts 66. At the upper end of the housing there is a collar with threaded portion 70 for mating with the bottom of a drill stem section. The space between housing 1' and pressure exchange vessel 65 represents a channel 71 for the passage of the drilling fluid with the direction of flow being indicated by arrows. A lower collar 70' provides connection to the next components of the drill string, which could be a drilling motor followed by one of the direct drill bit drives as disclosed herein previously. Before the apparatus is taken into service, at the surface, the pressure exchange vessel 65 is filled with the working gas that may be compressed to an initial pressure $p_{65\text{-}0}$ of several hundred bars. When lowered down into or being pulled up from the borehole, gas exchange with the working space of the heat engine-based drill bit drive can take place via pipeline 68 and may be controlled by the valve 67. The pipeline 68 runs alongside the pressure exchange vessel 65 and preferentially through one of the struts 66' and leaves the pressure exchange unit at the lower collar 70' and may have to pass other components of the drill string before reaching the heat engine.

Valve 67 and pipeline 68 are protected against the abrasive action of the incoming drilling fluid by a conical diverter dome 64.

FIG. 4 (*b*) is a schematic top plan view of the diverter dome with an elevational cross section of the housing as indicated by the section line A-A in FIG. 4 (*a*).

The length of the pressure exchange vessel 65 is not necessary in scale with its displayed diameter. It may be extended in length according to the volumetric requirements of the targeted drilling depth as indicated by the section line B-B.

At the lower part of the pressure exchange vessel there is a displacer unit 69 which includes a floating piston 69*a*. The piston is free to move against the gas pressure in the cylindrical part of the pressure exchange vessel. It is provided with o-ring seals or piston rings 69*e* and sufficiently long to retain a good guidance. For reasons of saving material, it can be hollow. The lower part of the piston forms an obturator plug 69*b* which at the surface or shallow drilling depths, i.e. as long as $p_{65\text{-}0} > p_{environment}$ is firmly pressed into the conical seat 69*c* by the internal gas pressure. Under these circumstances, the mechanical connection 69*b*/69*c* provides a hermetically sealed valve against the leakage of pressurized gas.

If, with increasing depth, the hydrostatic pressure within the borehole surpasses the (initial) pressure of the gas ($p_{65\text{-}o} \leq p_{environment}$), the piston 69*a* is pushed into the pressure exchange vessel and gives way to an inflow of drilling fluid through the openings 69*d* until the pressure is equilibrated again. The O-ring seals or piston rings 69*e* thus experience only a small pressure difference at any instant of the operation and can be e.g. made from a thermal and wear resistant elastomeric material. An additional sealing and lubricating effect is provided by a non-volatile auxiliary fluid 69*f*, which is floating above the level of drilling fluid due its lower specific gravity and immiscibility with it. At low external pressure, when the valve 69*b*/69*c* is closed, the auxiliary fluid is located within an additional chamber 69*g* and is expelled from it upwards as soon as the valve opens as described above. Another function of the fluid is to lubricate the seals of the floating piston 69*e* and provide a corrosion protection of the cylindrical wall of the pressure exchange vessel 65 by wetting the same. Upon withdrawal of the drill string from the borehole, the floating piston is moving downwards due to the expansion and back-streaming of the working gas from the heat engine. At the instant when the valve 69*b*/69*c* is closing, due to the taper of 69*c*, the auxiliary fluid is pressed through the remaining gap with an enhanced velocity. It can thereby remove solid particles that may have sedimented from the drilling fluid during drilling operation in larger depths. The valve seat 69*c* is thereby cleaned and a pressure and gas-tight seal upon reaching the surface is ensured.

According to another aspect to the invention, the pressure inside the heat engine that is powering the direct drill bit drive can be also adapted to the hydrostatic pressure of the drilling environment by means of a combined gas generating and absorbing unit which utilizes chemical reactions of solids with a high specific molar generation or conversion of gas molecules.

In the following, possible chemical reactions will be explained first, while secondly a discrete embodiment of such gas generating and absorbing unit will be given via detailed reference to FIG. 5.

Azides of alkaline or earth alkaline metals represent gas-generating chemicals with a high nitrogen content that is freed upon their thermal decomposition, e.g.

$$2NaN_3 \rightarrow 3N_2 + 2Na$$

In contrast to a majority of organic high-nitrogen compounds for example, this decomposition of metal azides does not simultaneously generate toxic gases or hydrogen. The latter may lead to an embrittlement of metal components of the hot gas engine.

The simple decomposition reactions like the one given above would result into reactive alkaline or earth alkaline metals that may represent another safety risk. There are however pyrotechnical mixtures and compositions on the basis of azides of alkaline or earth alkaline metals, where the decomposition reaction is modified by the use of additives or stoichiometrically added reactants to yield less harmful products. U.S. Pat. No. 3,865,660, for example, teaches utilization of water-free chromium chloride:

$$3NaN_3 + CrCl_3 \rightarrow 4\tfrac{1}{2}N_2 + 3NaCl + Cr$$

In U.S. Pat. No. 4,376,002 slag forming and moderating additives on the basis of the oxides of iron, silicon, manganes, tantalum, niobium, and tin are disclosed. In contrast to the conventional utilization of these compositions, e.g. in safety airbags, where low ignition temperatures and high decomposition rates are favored, for the present application as gas-generating agent in deep drilling environments, a mixture or composition with a high nitrogen content and a high ignition temperature above 300° C., preferably above 500° C., and a moderate decomposition rate is required.

Also, as the decomposition reaction is to be repeated many times, according to the aforementioned quasi-continuous supply of gas, the location within the device where the decomposition takes place (hereafter named reactor) shall not be clogged or otherwise affected by the solid reaction products. Therefore, the employed pyrotechnic mixtures may require further additives to prevent the formation of a larger mass of molten slag which may adhere irreversibly to the reactor wall.

The said limiting conditions are valid for the generation of gas required for a pressure increase during drilling operation and the lowering of the drill string into the borehole. When being pulled upwards from the bottom of the borehole, the average gas pressure within the heat engine has to be subsequently lowered. This cannot be accomplished via the release of gas into the borehole, because of the tremendous expansion of the gas bubbles on their way to the surface which can cause blowouts and other severe complications of the drilling fluid circulation.

Therefore it is necessary to absorb or convert the gas via chemical reactions into a product with significantly smaller volume, preferably a solid.

Preferred absorbents are nitride-forming metals and semi-metals, such as magnesium, silicon, titanium and zirconium with a high specific nitrogen uptake and a sufficiently high activation barrier for this reaction, in order to prevent self ignition at high nitrogen pressures:

$$3Mg + N_2 \rightarrow Mg_3N_2$$

$$3Si + 2N_2 \rightarrow Si_3N_4$$

$$2Ti + N_2 \rightarrow 2TiN$$

$$2Zr + N_2 \rightarrow 2ZrN$$

These materials are preferably used in a form with high surface area, such as a sponge, fabric or powder and the nitridation reaction ignited by heating with a direct electric current or by external heating. As the reactions are highly exothermic, good control of the supply of nitrogen gas to—and removal of the process heat from the reaction zone is required.

Of those elements listed above, silicon is especially preferred due to its high specific nitrogen-absorbing capability and handling safety, availability and price. The ignition temperature for the nitridation reaction of Si as given above is usually very high (1250-1450° C.) but it has been found that it can be reduced to below 1000° C. by addition of certain catalysts.

In consequence, according to this aspect of the invention, it is proposed to store gas generating and gas absorbing materials in the state of a free flowing powder, microbeads or pellets and automatically feed them into an electrically heated reaction zone at a rate that corresponds to the rate of the desired pressure change in the given volume of the heat engine-based drill bit drives plus all peripheral peripheral piping filled with the working gas.

FIG. 5 (*a*) to FIG. 5 (*c*) display different schematic cross sectional views of a proposed embodiment of a gas generating and absorbing unit which may be integrated within the drill string and located above the heat engine-based drill bit drive and a drilling motor.

FIG. 5 (*a*) is a cross sectional view parallel to the axis of the gas generating and absorbing unit as indicated by line C-C in FIG. 5 (*b*)

FIG. 5 (*b*) is a fragmentary cross sectional view perpendicular to the axis of the gas generating and absorbing unit FIG. 5 (*c*) is an elevational view of the gas generating and absorbing unit sectioned and unrolled along the line B-B in FIG. 5 (*a*). Components that are not located within this section line may be included in order to assist the explanations.

The gas generating and absorbing unit is integrated into a cylindrical housing 1'. The unit as a whole is gas tight and designed to withstand an initial internal gas pressure which is typically in the range of 50-100 bar, without bulging.

The unit may be connected to a drilling stem via a threaded portion (not shown) located above the collar 70. The drilling fluid is guided through the apparatus towards the drilling engine and a heat-engine based drill bit drive via a central channel 71, with the direction of flow being indicated by an arrow. In the upper part of the unit, concentrically arranged around the central channel, there are two storage vessels for the gas generator and gas absorbing materials, 73 and 74, respectively. In the lower part, the corresponding storage vessels for the respective reaction products 75 and 76 are located.

The length of these storage vessels may or may not be displayed in scale with their diameter. Depending on the amount of gas to be produced or absorbed in the course of a discrete drilling operation, the unit can be extended at the section lines C-C and F-F in FIG. 5 (*b*) respectively. Moreover, according to their specific gas storage capacity, a different volume ratio between the gas generating and absorbing agent may be realized by choosing angular separations between the walls 77, 78 and 79 different to those being displayed in FIG. 5 (*a*).

A decomposition reactor 80 and a gas absorption reactor 81 are located at an axial position that is approximately in the middle of the entire unit. Each one is provided with a thermal insulation 81*a* and an electric resistance heating 81*b*. In order to prevent a temperature overshoot due to the high reaction enthalpies, the reactors may be cooled by heat transfer to the drilling fluid. This is accomplished via cooling ducts 83*a* that run parallel to the cylinder axes of the reactors. The flow of coolant can occur self-sustained by the natural pressure difference between the drilling fluid in the main channel 71 being pumped downwards and the discharged fluid outside of the housing 1' that flows upward to the surface. The intake of fluid can be accomplished by a central inlet openings 83*b*. The stream of fluid is controlled by one regulation 83*c* for each reactor and then distributed into individual cooling ducts 83*a* via a toroidal manifold 83*d*.

The average feeding rate of free flowing solid gas generating and absorbing material is controlled by means of dosing feeders 84 which are to be equipped with appropriate means to prevent a flashback of the reaction into the storage vessels.

The reactors 80 and 81 are constructed in a manner as to provide a sufficient thermal contact and sufficiently long exposure time for the decomposition and nitridation reaction to occur. In the present embodiment, this is accomplished by the use of conveying screws 81*c* with electrical drives 81*d*, shown in FIG. 5 (*b*). Representation of the required voltage supply is omitted for clarity.

The generated gas leaves the reactor via the filling tube 85 together with solid reaction products transported by the conveying screw 81*c* into the storage container 75, which is also serving a buffer volume for pressure peaks in case of a batchwise decomposition and for the sedimentation of dust particles of the reaction product suspended within the gas. Final removal of particles from the gas is accomplished by a filter unit 86. The gas then flows through a heat exchanger 87 that is integrated into the main gas distribution channel 88 and cooled via thermal contact to the drilling fluid through the walls of the housing 1' and the central channel 71. Pressure equilibration within the whole unit, in particular between the gas distribution channel and the storage vessels 73, 74, 75 and 76 is accomplished via respective openings 89. The openings can be protected by safety valves (not displayed).

The pressure exchange with gas-filled volumes located outside the gas generator and absorber unit, in particular with the heat-engine based drill bit drives is accomplished via a connector flange indicated as an opening 90 at the bottom of FIG. 5 (*c*). From there, the gas can pass other components such as the drilling motor through a pipeline system until if finally reaches the drill bit drive at the bottom of the drill string. For the entry and removal of gas into and from the heat engine itself, a control valve in the vicinity of the cylinder head 3*a* in FIG. 1 or the corresponding component 3*a'* in the thermoacoustic engines on FIG. 3 is proposed.

During pressure build-up gas is generated until the overpressure in the pipeline opens the valve and new working gas can flow into the engine.

When the average pressure is to be released, the control function of the valve may be reverted, successively allowing small amounts of gas to leave the engine when the pressure amplitude at the upper working space it is at maximum.

For the absorption of gas by the proposed embodiment, the working gas is fed through the gas absorption reactor by a fan 91 via a duct 92 from where it enters the hollow and perforated shaft 81*c'* of the conveying screw. Circulation of the gas along 88→91→92→81→85→86→89→88 accomplishes its successive consumption into a solid product.

It will be anticipated to those skilled in the art that the gas absorption reactor can be realized in various other forms, for example according to the principle of a fluidized bed oven.

LIST OF REFERENCE NUMERALS

1 cylindrical housing of the drill bit drive
1' cylindrical housing of the pressure equilibration vessel
2 percussive drill bit unit
2*a* bit adaptor
2*b* drill bit
2*c* flush channel
2*d* tungsten carbide inserts
2*e* anvil
3 cylindrical pressure vessel
3*a* heated cylinder head (free piston Stirling)
3*a'* non-heated cylinder head (thermoacoustic Stirling)
3*b* displacer piston cylinder
3*g* power piston cylinder
3*h* bellow
3*i* bottom plate
3*b'* upper resonator tube of the thermoacoustic engine
3*g'* lower resonator of tube the thermoacoustic engine
4 thermal insulation
5 electric resistance heater
6 electric lead
7 gas-tight electric duct
7' gas-tight drive shaft sealing
8 heat conductor/heat exchanger
9 supply pipe
10 fuel supply pipe and nozzle
11 intake manifold
12 exhaust
13 drive shaft
13*a* hub
14 rotating friction disc
14' friction material

14*b* radial struts of the friction disc
14*c* friction rings
15 stationary friction disc
15' segmented friction elements
16 pretensioning jig
17 drive shaft bearing
18 expandable actuator elements
18' actuator elements
19 load frame
19*a* intermediate bottom
20 compression elements
20' thermal insulation
21 regenerator
22 low temperature heat exchanger
22*a* heat exchanger struts
22*b* heat exchanger coil
22*c* coolant manifold
22*d* coolant pump
22*d'* variant for cooling pump
30*b* displacer piston
30*c* piston rod
30*d* upper cylinder volume in the power piston
30*e* small piston within the power piston
30*f* lower cylinder volume in the power piston
30*g* power piston
30*h* striker piston
40 upper (hot) end of the pressure vessel
41 lower (cold) end of the pressure vessel
42 collision space
43 extended collision space with bypass volume
50 cylinder for striker piston
51 openings
52 actuator unit
53 control valve
FIG. 4
60 rotating heater and regenerator stack
61 metal cylinder
62 spokes
63 radial stack plates
64 flow diverter dome
65 pressure exchange vessel
66 struts
66' strut with gas pipe
67 valve
68 pipeline (working gas)
69 displacer unit
69*a* floating piston
69*b* obturator plug
69*c* conical valve seat
69*d* channels for drilling fluid
69*e* O-ring seal/piston ring
69*f* auxiliary fluid with specific gravity $\rho<\rho$(drilling fluid)
69*g* lower chamber for auxiliary fluid
70 collar with threaded portion towards drill stem
70' collar with threaded portion towards drilling engine
71 main channel for drilling fluid
FIG. 5
73 storage vessel for gas generator material
74 storage vessel for gas absorbent
75 storage vessel for solid gas generator products
76 storage vessel for used gas absorbent
77, 78, 79 separation walls
80 decomposition reactor
81 gas absorption reactor
81*a* thermal insulation
81*b* electric heaters
81*c* conveying screw
81*c'* hollow drive shaft of the gas absorption reactor
81*d* electric drive for conveying screw
83*a* cooling ducts
83*b* cooling fluid (=drilling fluid) inlets
83*c* regulation valves
83*d* toroidal manifold
84 dosing feeder for gas-generating agent with non-return flap
85 filling tube
86 filter unit
87 heat exchanger
88 main gas distribution channel for working gas
89 openings for working gas
90 connector flange
91 fan for gas-supply of the gas-absorber reactor
92 gas supply pipe for absorber unit

The invention claimed is:

1. Direct drill bit drive for percussive tools to comminute or penetrate brittle materials on the basis of a heat engine that works with a gaseous working fluid,
specified by
the fact that the heat engine works according to a real thermodynamic Stirling cycle, wherein
the material to be comminuted or penetrated is located outside of said heat engine.

2. Direct drill bit drive according to claim 1,
specified by
the fact that the heat engine is a free piston Stirling engine with a power piston (30*g*) and a displacer piston (30*b*) being centered on a common axis of a cylindrical pressure vessel (3).

3. Direct drill bit drive according to claim 1,
specified by
the fact that percussive pulse is created via mechanical collision of the power piston (30*g*) with the movable surface of an anvil or piston facing the lower space (40,41) of the engine.

4. Direct drill bit drive according to claim 1,
specified by
the fact that the heat engine is a thermoacoustic engine (laminar flow engine) with preferably cylindrically shaped pressurized resonator tube (3).

5. Direct drill bit drive according to claim 1,
specified by
the fact that percussive pulses are generated via transmission of oscillating pressure variations and oscillating displacement of the working fluid onto a movable piston or surface (3*i*) facing the working space (40,41) of the engine.

6. Direct drill bit drive according to claim 1,
specified by
the fact that thermal energy for the heat engine is provided by an electric resistance heater (5).

7. Direct drill bit drive according to claim 6,
specified by
the fact that the electric power required for the electric resistance heater (5) is provided by an electrical generator at the surface or a down-the-hole electric generator that is driven by the drilling fluid.

8. Direct drill bit drive according to claim 1,
specified by
fact that thermal energy for the heat engine is provided by a hot fluid that is fed through a heat exchanger (8) located at the upper end of the working space of the engine.

9. Direct drill bit drive according to claim 8,
specified by
the fact that the hot fluid is created from a liquid or gaseous exothermic chemical reaction mixture or an aerosol or suspension of a reactive solid within a fluid.

10. Direct drill bit drive according to claim 1,
specified by
the fact that the thermal energy for the heat engine is provided by a hot flame from a burner (10).

11. Direct drill bit drive according to claim 1,
for which
thermal energy for the heat engine is provided as frictional heat.

12. Direct drill bit drive according to claim 11,
for which
the frictional heat is produced by a rotating friction pair (14, 15; 14', 15') driven by a hydraulic engine or turbine.

13. Direct drill bit drive according to claim 1,
specified by
the fact that the lower part of the working space (3) of the Stirling engine is equipped with an additional striker piston (30*h*) that is moving freely in its own cylinder (50); Percussive pulses are created by mechanical collisions of the striker piston with an anvil (2*e*) transmitting the pulses towards a percussive drill bit (2).

14. Direct drill bit drive according to claim 1,
specified by
the fact that the percussive drill bit (2) is provided with a mechanism for rotational indexing of the bit (2*b*).

15. Direct drill bit drive for percussive deep drilling on the basis of a heat engine that works with a gaseous working fluid,
specified by
the fact that the heat engine works according to a real thermodynamic Stirling cycle and the average pressure within the engine is adapted to the pressure of the drilling environment via a gas-filled pressure exchange vessel (65) that is integrated into the drill string outside of the heat engine, which affords an intake or outflow of a working medium into the engine due to expulsion from or expansion into the exchange vessel, or
a gas-generating and absorbing unit that is integrated into the drill string which affords the generation of a working medium from a solid or the absorption of a working medium into a solid via a chemical reaction.

* * * * *